US009635986B2

(12) United States Patent
Phelps

(10) Patent No.: US 9,635,986 B2
(45) Date of Patent: May 2, 2017

(54) SPINDLE AND ADAPTER FOR ROLL PAPER PRODUCT DISPENSERS

(75) Inventor: Stephen Lawrence Phelps, Lilburn, GA (US)

(73) Assignee: SOLARIS PAPER, INC., Alpharetta, GA (US)

( * ) Notice: Subject to any disclaimer, the term of this patent is extended or adjusted under 35 U.S.C. 154(b) by 526 days.

(21) Appl. No.: 13/288,693

(22) Filed: Nov. 3, 2011

(65) Prior Publication Data

US 2012/0111987 A1 May 10, 2012

Related U.S. Application Data

(60) Provisional application No. 61/409,626, filed on Nov. 3, 2010.

(51) Int. Cl.

| | |
|---|---|
| ***B65H 75/02*** | (2006.01) |
| ***A47K 10/40*** | (2006.01) |
| ***B65H 75/22*** | (2006.01) |
| ***B65H 75/18*** | (2006.01) |

(52) U.S. Cl.

CPC ..... *A47K 10/40* (2013.01); *B65H 75/185* (2013.01); *B65H 75/22* (2013.01)

(58) Field of Classification Search

CPC ..... A47K 10/40; B65H 75/22; B65H 75/185
USPC ..... 242/560, 599, 561, 578, 598, 599.3, 242/599.4, 607, 608, 608.1, 608.6, 609, 242/609.1, 612
See application file for complete search history.

(56) References Cited

U.S. PATENT DOCUMENTS

| | | | | |
|---|---|---|---|---|
| 1,107,328 | A * | 8/1914 | Linder | 242/578 |
| 1,391,326 | A | 9/1921 | Killian | |
| 1,778,856 | A | 10/1930 | Hoegger | |
| 2,209,471 | A | 7/1940 | Olken et al. | |

(Continued)

FOREIGN PATENT DOCUMENTS

| | | |
|---|---|---|
| GB | 731449 | 6/1955 |
| WO | 2009/027873 | 3/2009 |

OTHER PUBLICATIONS

Patent Cooperation Treaty, "Notification of Transmittal of the International Search Report and the Written Opinion of the International Searching Authority, or the Declaration", PCT Application No. PCT/US12/63396, issued Mar. 18, 2013.

*Primary Examiner* — Emmanuel M Marcelo
*Assistant Examiner* — Justin Stefanon
(74) *Attorney, Agent, or Firm* — Fish & Tsang, LLP

(57) ABSTRACT

A spindle for dispensing a roll of paper product is described. The spindle has an elongated member rotatably coupled with two side members. The side members have different sections of various diameters, which are configured to allow a portion of the side members to be inserted into a hollow interior of the elongated member. The elongated member has sufficient elasticity to provide a snap connection with the side members. The side members are configured to engage a track in a dispenser. Furthermore, at least one of the side members is removable. Also described herein is a roller assembly for adapting a dispenser. The assembly comprises a spindle rotatably coupled with a housing. The housing includes a fastener for attaching the housing to a dispenser. The roller assembly is configured to raise a roll of paper product, thus allowing dispensers originally designed for core rolls to be used with coreless rolls.

20 Claims, 4 Drawing Sheets

(56) References Cited

U.S. PATENT DOCUMENTS

| | | | | | |
|---|---|---|---|---|---|
| 2,289,453 | A | | 7/1942 | Randall | |
| 2,289,519 | A | | 7/1942 | Randall | |
| 2,309,539 | A | * | 1/1943 | Roehrl | 242/578.3 |
| 2,331,743 | A | | 10/1943 | Sullivan | |
| 2,486,607 | A | * | 11/1949 | Laystrom et al. | 242/599.3 |
| 2,571,321 | A | * | 10/1951 | Wettley | 242/599.4 |
| 2,621,867 | A | | 12/1952 | Grettve | |
| 2,762,575 | A | | 9/1953 | Miller | |
| 3,297,269 | A | * | 1/1967 | McGrew | 242/564.4 |
| 3,700,181 | A | | 10/1972 | Diring et al. | |
| 3,770,221 | A | | 11/1973 | Stern | |
| 4,212,434 | A | | 7/1980 | Walker | |
| 4,422,585 | A | | 12/1983 | Schultz et al. | |
| 4,447,015 | A | | 5/1984 | Peterson | |
| 4,856,724 | A | * | 8/1989 | Jespersen | 242/560.1 |
| 5,135,179 | A | | 8/1992 | Morano | |
| 5,143,316 | A | * | 9/1992 | Goetz | B65H 49/32 242/118.61 |
| D340,822 | S | | 11/1993 | Morand | |
| 5,288,032 | A | * | 2/1994 | Boone et al. | 242/560.3 |
| 5,335,873 | A | * | 8/1994 | Harris | B65H 16/00 242/348 |
| 5,370,336 | A | | 12/1994 | Whittington | |
| 5,370,339 | A | * | 12/1994 | Moody et al. | 242/597.6 |
| 5,451,013 | A | * | 9/1995 | Schutz | 242/597.4 |
| 5,467,935 | A | | 11/1995 | Moody | |
| 5,495,997 | A | | 3/1996 | Moody | |
| 5,558,302 | A | * | 9/1996 | Jesperson | 242/560 |
| 5,577,686 | A | * | 11/1996 | Moody | 242/597.4 |
| 5,597,135 | A | * | 1/1997 | Vandersteene | 242/599.4 |
| 5,664,739 | A | * | 9/1997 | Black et al. | 242/588.2 |
| 5,669,576 | A | * | 9/1997 | Moody | 242/560.3 |
| 6,056,233 | A | | 5/2000 | Von Schenk | |
| 6,250,530 | B1 | * | 6/2001 | LaCount et al. | 225/10 |
| 6,422,505 | B1 | | 7/2002 | Froesel | |
| 6,736,349 | B1 | * | 5/2004 | Boisdon | B65H 75/22 242/118.61 |
| 7,140,573 | B1 | * | 11/2006 | Jerstroem | A47K 10/3836 242/597.3 |
| 2002/0017588 | A1 | * | 2/2002 | Kitayama | B65H 75/22 242/608.6 |
| 2002/0134881 | A1 | * | 9/2002 | Hoernig | A47K 10/40 242/599.1 |
| 2009/0008494 | A1 | * | 1/2009 | Maley | B65H 49/305 242/608.5 |

* cited by examiner

FIG. 1
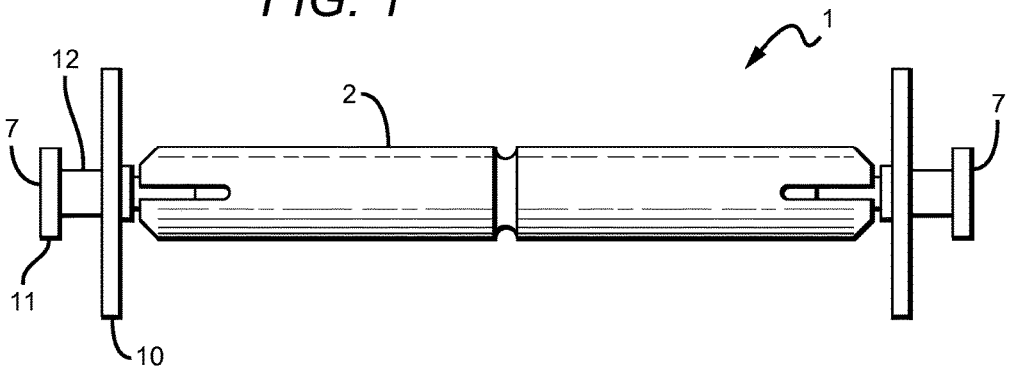
FIG. 2
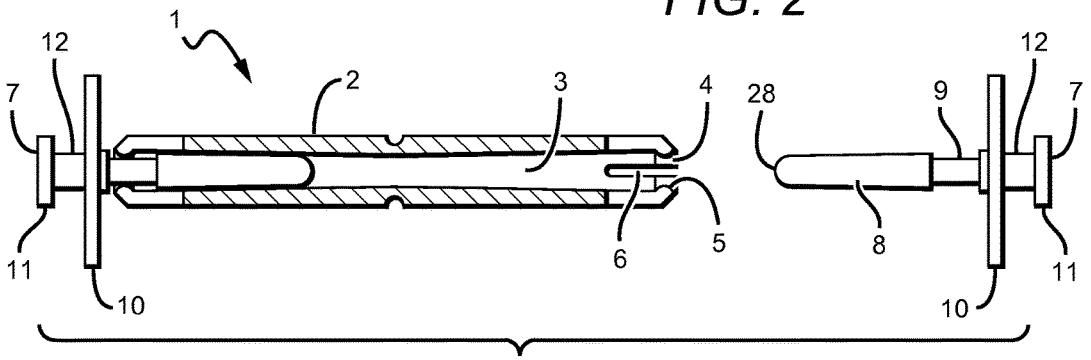
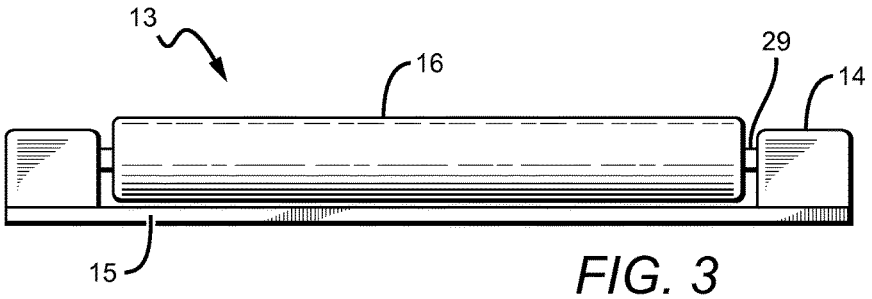
FIG. 3
FIG. 4
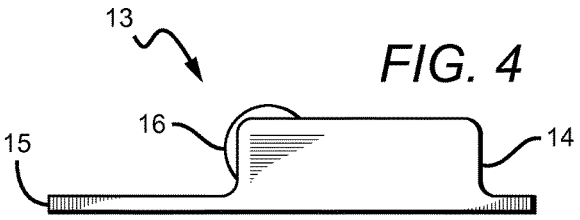

SPINDLE AND ADAPTER FOR ROLL PAPER PRODUCT DISPENSERS

This application claims the benefit of priority to U.S. provisional patent application Ser. No. 61/409,626, filed on Nov. 3, 2010.

FIELD OF THE INVENTION

The field of the invention is dispensers, more specifically, spindles with rotatable ends for dispensing roll paper products.

BACKGROUND

Spindles are commonly used for winding and unwinding roll paper products (e.g., toilet paper, paper towels). Numerous designs for spindles and dispensers have been developed over the years. See, for example, U.S. Pat. Nos. 1,391,326, 1,778,856, 2,209,471, 2,289,453, 2,289,519, 2,331,743, 2,621,867, 2,762,575, 3,770,221, 4,212,434, 4,422,585, 4,447,015, 5,370,336, 5,669,576, 5,669,576, 6,422,505, D0,340,822, International Patent Application Publication No. WO 2009/027873, and Great Britain Patent No. 731449.

These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

U.S. Pat. No. 5,669,576 to Moody describes a spindle with a rotating sleeve (i.e., the sleeve rotates with respect to the spindle's two ends). The spindle can be used in a vertical dispenser housing that holds two rolls of paper product. The spindle is specifically designed for coreless rolls of toilet paper. As used herein, "coreless" means a roll of product having no separate core material (e.g., the cardboard core in household toilet paper rolls). "Coreless" also generally implies that the center aperture of the roll of product is less than that of a similar size roll having a core, although this may not always be the case. Since the center aperture of coreless roll products tends to collapse when the roll is mostly depleted, it is desirous that the spindle frictionally engage the center aperture (e.g., "interference fit") in order to achieve complete depletion of the roll. This, in turn, requires that the spindle's middle rotate with respect to the spindle's end. The spindle in Moody is particularly useful because it allows coreless rolls to be used with dispensers that were originally designed for core rolls.

Unfortunately, the spindle in Moody is complex and requires at least four separate parts. Furthermore, assembling the spindle requires many steps, which increases the time required to re-load the spindle with a new roll of paper product. Moody and all other known prior art have failed to provide a simple design for a spindle having rotating ends. It has yet to be appreciated that such a spindle can be assembled with three parts and in one easy step.

Moody also discloses an adapter comprising a bottom block with upward protrusions (see Moody at FIGS. 6 and 12, part no. 90), which is useful for adapting dispensers originally designed for use with core rolls to be used with coreless rolls. Since coreless rolls generally have a smaller center aperture diameter than core rolls, the trigger mechanism in the dispenser is activated prematurely when coreless rolls are used, causing the secondary roll to drop down before the primary roll is fully depleted. The upward protrusions raise a coreless roll of paper product up to an appropriate height, thus preventing premature activation of the trigger mechanism when coreless paper products are used. Unfortunately, the block and protrusions must come in direct contact with the roll, which adds friction to the unwinding of a roll of paper product. This friction can lead to premature breakage of a web of paper product. Moody and all other known prior art fail to provide an upward protrusion that prevents premature activation of a trigger mechanism, without adding substantial friction to the unwinding of the rolls of paper products.

Thus, there is still a need for improved spindles and adapters.

SUMMARY OF THE INVENTION

The inventive subject matter provides apparatus, systems, and methods in which a spindle for dispensing a roll of paper product has three parts: one elongated member and two end members that rotatably couple with the elongated member. In addition, at least one of, and preferably both of, the end members are removeably coupled with the elongated member. Each end member preferably has a flange configured to slideably engage a track of a dispenser.

In one aspect of some preferred embodiments, the spindle's elongated member has a hollow interior and side openings. Each side opening preferably has a diameter smaller than the inner diameter of the hollow interior. In addition, the end members each have first, second, and third sections. The first section has a maximum diameter smaller than the diameter of the hollow interior and larger than the diameter of the first and second openings. The second section has a maximum diameter smaller than the diameter of the side openings. The third section has a maximum diameter greater than the diameter of the hollow interior. The first section of each end member can be inserted into the side openings of the elongated member and snapped into place in a manner that allows the elongated member to rotate with respect to the end members. The elongated member is preferably made of a material that has sufficient elasticity to allow its side openings to expand (e.g., bend outward) when inserting the end members into the elongated member, without causing permanent deformation of the side openings (i.e., the side openings are configured to function as snap connectors). This configuration allows each end member to removeably and rotatably couple with the elongated member. In other aspects of some preferred embodiments, the first section of the end members preferably has a tapered profile to facilitate inserting the first section into the elongated member's hollow interior.

In yet other aspects of some preferred embodiments, the outer diameter of the elongated member is smaller than the inner diameter of a center aperture of a roll of paper product, thus allowing the elongated member to be easily inserted into the center aperture. In other embodiments, the diameter of the elongated member is substantially equal to, or slightly larger than, the diameter of the center aperture, thus providing an interference fit with the roll of paper product.

The inventive subject matter also provides apparatus, systems, and methods in which a dispenser for dispensing rolls of paper products includes a housing, at least two of the spindles as described above, and a roller assembly. The housing has an interior space for storing two rolls of paper product. In addition, the housing has two opposing tracks disposed in the interior space of the housing. The tracks are configured to receive a portion of the spindle ends, allowing the spindle to slide along the tracks within the dispenser. The roller assembly is disposed in the interior space of the housing and is configured to (i) contact a roll of paper product during dispensing, and (ii) rotate with respect to the housing.

In some aspects of preferred embodiments, the interior space is configured to vertically store two rolls of paper product. However, interior spaces configured to horizontally store two rolls of paper products are also contemplated.

The inventive subject matter also provides apparatus, systems, and methods in which a roller assembly for a roll paper product dispenser includes a housing, a spindle rotatably coupled with the housing, and a fastener configured to attach the housing to a dispenser. In some embodiments, the housing comprises a flat portion and first and second arms, wherein first and second arms are configured to rotatably couple with the spindle.

The inventive subject matter also provides apparatus, systems, and methods in which a kit for a roll paper product dispenser comprises two spindles as described above, the roller assembly as described above, and instructions for using and installing the spindles and the roller assembly.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWING

FIG. 1 is a front view of one embodiment of a spindle having rotatable ends.

FIG. 2 is a front section view of the spindle of FIG. 1.

FIG. 3 is a front view of one embodiment of a roller assembly.

FIG. 4 is a side view of the roller assembly of FIG. 3.

DETAILED DESCRIPTION

Figure 5:
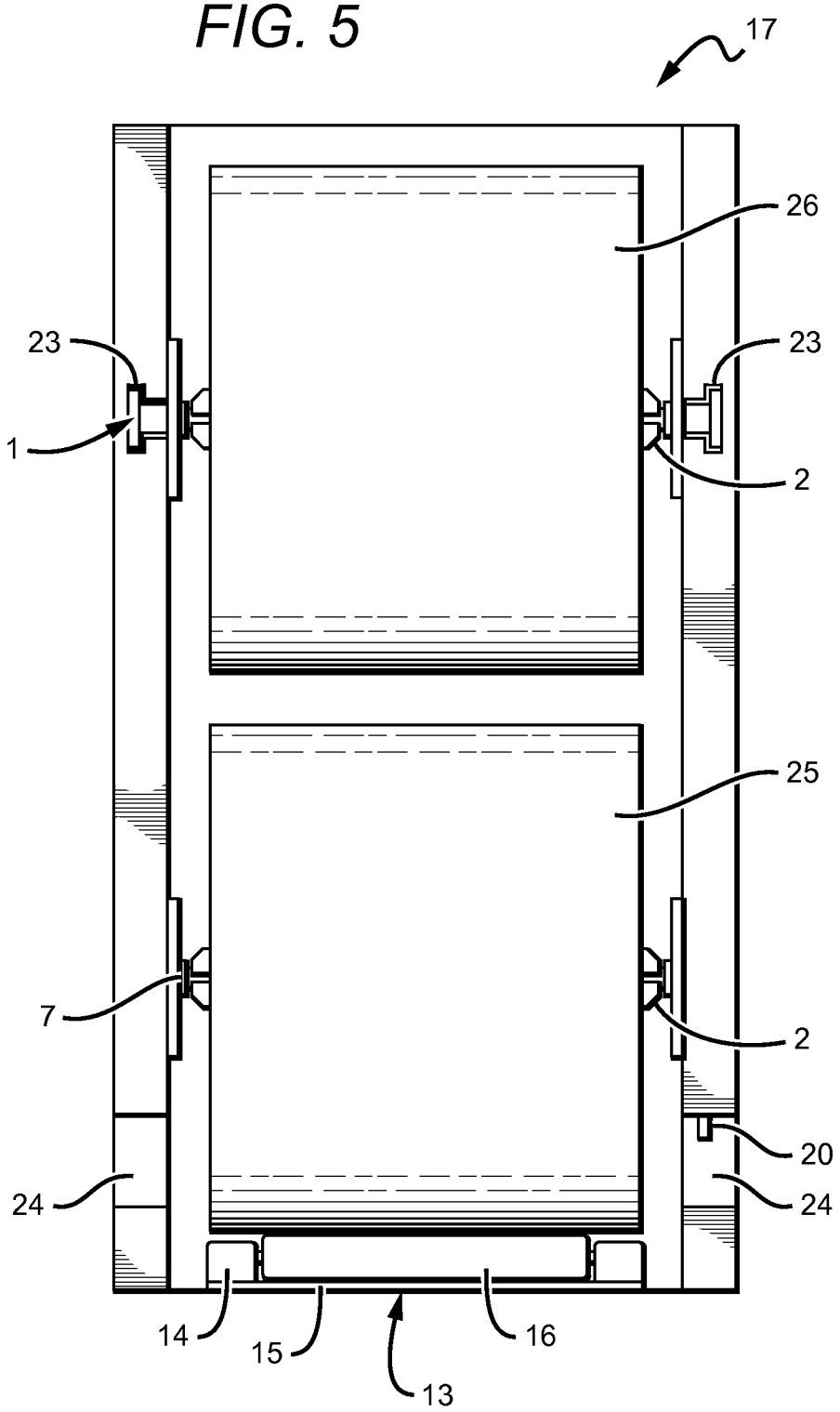
FIG. 5 is a front view of a dispenser with two full rolls of toilet paper.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

FIG. 1 shows a front view of a spindle 1, which incorporates an elongated member 2 and two identical end members 7. End members 7 are configured to rotatably and removable couple with elongated member 2. Loading a roll of toilet paper requires the removal of one of the end members 7 from elongated member 2. Once the roll of toilet paper is loaded onto elongated member 2, the removed end member 7 can be snapped back into the hollow interior 3 (see FIG. 2) of elongated member 2.

FIG. 2 shows a front section view of spindle 1, showing how elongated member 2 snap-fastens to end members 7. Elongated member 2 has a hollow interior 3, two openings 4 with snap features 5, and two notches 6. End member 7 has a first diameter section 8 that fits into hollow interior 3. The maximum diameter of section 8 is less than the inner diameter of hollow interior 3 and greater than the diameter of opening 4. Elongated member 2 is configured to have sufficient elasticity such that opening 4 can expand to receive section 8 of end member 2 without permanently deforming. Notches 6 are included in order to allow openings 4 to temporarily expand (e.g., temporarily increase in diameter by bending outward). Section 8 is tapered (e.g., the diameter at round end 28 gradually increases along the length towards section 9) in order to facilitate inserting section 8 into opening 4 and to allow for gradual expansion of opening 4.

End member 2 also has a second diameter section 9, which has a maximum diameter smaller than the diameter of openings 4. Section 8 allows opening 4 to contract to its resting state once section 7 is completely inserted into hollow interior 3. Section 8 also allows end member 7 to rotate with respect to elongated member 2. While section 9 is shown as having a constant diameter and cross-section, those of skill in the art will appreciate that non-constant shapes and profiles can also be used consistently with the inventive concepts discussed herein. For example, section 9 could have a convex shape with a maximum diameter no greater than the diameter of opening 4.

End member 2 also has a third diameter section 10. Section 10 has a diameter substantially larger than the diameter of openings 4 and servers as a stop to prevent end member 7 from being further inserted into hollow interior 3. While section 10 could have any diameter larger than openings 4 to serve as a stop, section 10 preferably has a diameter larger than hollow interior 3 to prevent section 10 from being inserted into hollow interior 3.

Spindle 1 also includes a snap feature 5, which is configured such that the end members 7 will snap-lock with elongated member 2 in such a manner as to not allow end members 7 to become dislodged during handling or loading of a roll of paper product. In other words, the force required to release the snap-lock engagement is substantially greater than forces applied to spindle 1 during use of the spindle 1 (e.g., loading spindle 1 into a dispenser, unwinding paper product from spindle 1).

End member 2 also has a fourth diameter section 11 and a fifth diameter section 12. Sections 11 and 12 are configured to engage track 22 and track opening 23 of dispenser 17 (see FIGS. 7 and 8). Sections 11 and 12 also provide a place to grip end member 7 when a roll of paper product is loaded. Those of skill in the art will appreciate that numerous shapes and configurations of engaging tracks and diameter sections are possible and can be used consistently with the inventive subject matter disclosed herein. For example, in other embodiments section 11 could be eliminated and section 12 could have a length sufficient to prevent spindle 1 from dislodging from track 22 while sliding along the track.

The steps for using spindle 1 are as follows: (1) remove one of the end members 7 from elongated member 2; (2) insert elongated member 2 into a center aperture of a roll of paper product; (3) insert end member 7 back into hollow interior 3 of elongated member 2; (4) load spindle 1 into a dispenser track opening 23. The simplicity of reloading rolls provides an advantage over prior art, such as Moody, in which multiple components must be assembled in a specific order and orientation using numerous steps. Spindle 1 also allows a roll of paper product to be loaded from either end, thus avoiding the need to check for which end is removable. However, two-piece spindles in which only one end is removable are also contemplated.

While the spindles disclosed herein are specifically contemplated for use with rolls of absorbent paper products (e.g., toilet paper, tissue paper, napkins, paper towels), those of skill in the art will appreciate that the inventive concepts presented herein can be applied to any web of material, whether absorbent paper or not. Examples of non-paper and/or non-absorbent rolls could include rolls of plastic wrap and rolls of aluminum foil. Other examples include rolls of stamps and tickets. As such, the inventive subject matter is not intended to be limited by "rolls of paper products."

Furthermore, while the spindles disclosed herein are particularly useful for adapting dispensers originally designed for core paper products for use with coreless paper products, those of skill in the art will appreciate that the inventive concepts taught herein can be used for both core and coreless rolls of paper product. In other words, spindle 1 can be configured with a diameter slightly larger than, or substantially equal to, the diameter of a center aperture of a roll of paper product (i.e., interference fit for coreless rolls), or alternatively, with a diameter smaller than the diameter of a center aperture of a roll of paper product (e.g., core rolls).

Those of skill in the art will also appreciate that configurations other than those shown in FIGS. 1 and 2 are possible for achieving a rotatable coupling between elongated member 2 and end members 7. For example, elongated member 2 could be a solid part with tapered ends that are configured to fit into a hollow interior within section 8 of end members 7 (i.e., the direction of the snap-fit connection is reversed). In other embodiments, first section 8 could comprise a sphere shape rather than a long tapered section.

FIG. 3 shows a front view of roller assembly 13, which includes a spindle 16 and housing 14. Spindle 16 is rotatably coupled to housing 14 via mandrels 29, which have an outside diameter less than that of the inside diameters of the corresponding recesses in housing 14 and spindle 16. Housing 14 has a base portion and two opposing arms for holding spindle 16.

FIG. 4 shows a side view of roller assembly 13 showing spindle 16, housing 14 and front edge 15. Roller assembly 13 can be installed in a dispenser for the purpose of repositioning a roll of paper product. Since core paper products generally have a greater center aperture diameter than coreless paper products, dispensers specifically designed for core paper products may not be compatible with coreless paper products. For example, the dispenser disclosed in Moody has a trigger mechanism that controls when a secondary roll of paper product drops down into a dispensing position to replace a primary roll. The trigger mechanism is activated prematurely when coreless paper products are used, due to the difference in diameter of the center apertures of core and coreless rolls. Roller assembly 13 can be installed into the dispenser disclosed in Moody in order to adapt the dispenser for use with coreless rolls (i.e., roller assembly 13 raises a coreless roll of paper product to prevent premature activation of the trigger mechanism).

Roller assembly 13 can be installed by: (1) placing roller assembly 13 into the bottom of the dispenser; (2) aligning front edge 15 with the bottom front edge of the dispenser (see FIGS. 6 and 8); and (3) engaging a double-sided adhesive tape on the bottom side of housing 14 with a dispenser wall. The dimensions of housing 14 are configured such that aligning front edge 15 with the front edge of the dispenser causes the centerline of spindle 16 to align with the center of the dispenser's track, placing roller assembly 13 directly below the roll of paper product. It is also contemplated that other embodiments could place roller assembly 13 slightly behind the track 22, thus causing spindle 1 to move forward when the roll of paper product is depleted.

Those of skill in the art will appreciate that fasteners other than double-sided tape can be used to attach roller assembly 13 to a dispenser. Screws, magnets, male-female connectors, and other fasteners are specifically contemplated. Fasteners are well known and the inventive subject matter is not intended to be limited by fastener types.

Roller assembly 13 provides an improvement over the upward protrusions of the adapter disclosed in Moody, by reducing the frictional force placed on a roll of paper product during dispensing. As a roll of paper product is dispensed, spindle 16 rotates (due to the rotational coupling of spindle 16 to housing 14), thus reducing friction between roller assembly 13 and the roll of paper product and thus eliminating any undesirable breakage of the web.

FIG. 5 shows a front view of dispenser 17 with two full rolls of paper product loaded in the dispenser on a spindle of the kind described above. Prrimary roll of paper product 25 is in the lower dispensing position and secondary roll of paper product 26 is held in the upper or reserve position. Primary roll 25 was loaded into dispenser 17 by mounting roll 25 on spindle 1 and then inserting the ends of spindle 1 through track openings 23. Primary roll 25 then dropped down track 22 (see FIG. 6) into the lower dispensing position rotating release mechanism 18 (see FIGS. 7 and 8) backward. This caused hold end 19 (see FIGS. 7 and 8) to rotate forward about pivot point 21, thus blocking track 22. Secondary roll 26 was then loaded into track openings 23 in a similar manner, and is held in the reserve position by hold end 19 (see FIGS. 7 and 8).

Figure 6:
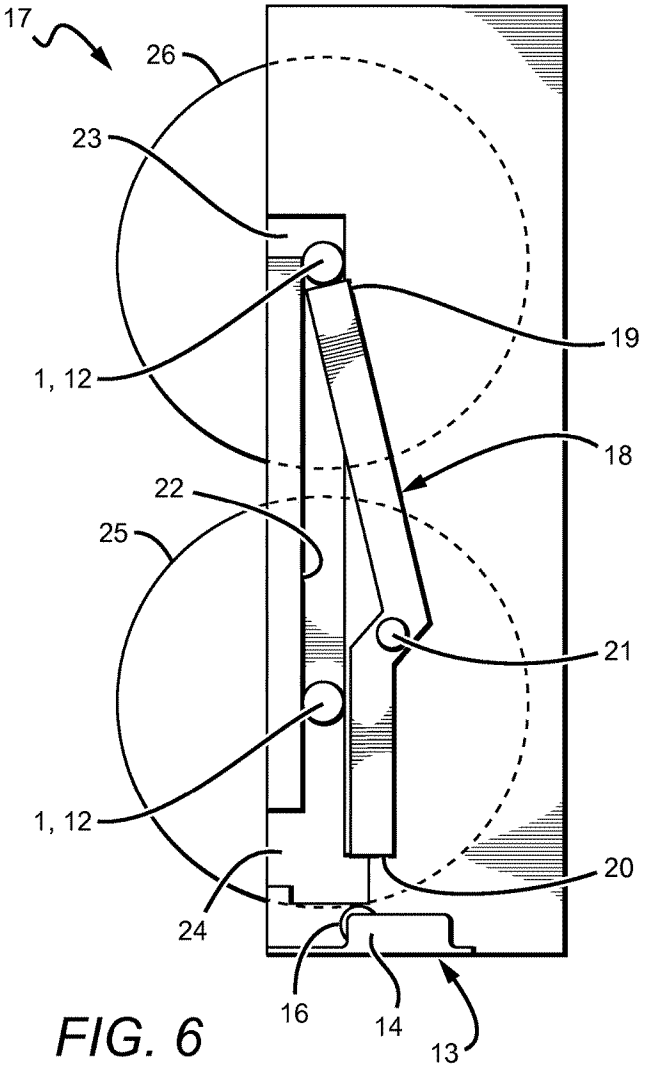
FIG. 6 is a side view of the dispenser of FIG. 5.

FIG. 6 shows a side view of dispenser 17 with two full rolls of paper product loaded in the dispenser. Primary roll 25 rests on spindle 16 of roller assembly 13. This view also shows how release mechanism 18 is positioned such that hold end 19 prevents secondary roll 26 from falling down track 22. Also shown is track 22, which incorporates opening 23 and unload opening 24. Openings 23 and 24 can be used for loading and removing spindle 1, respectively. End members 7 of spindles 1 are configured to travel along track 22. Release mechanism 18 utilizes gravity to force the trigger end 20 forward, thus pushing on section 12 of end members 7. As long as section 12 is in contact with release mechanism 18, hold end 19 blocks track 22 and prevents secondary roll 26 from dropping into the lower dispensing position.

Figure 7:
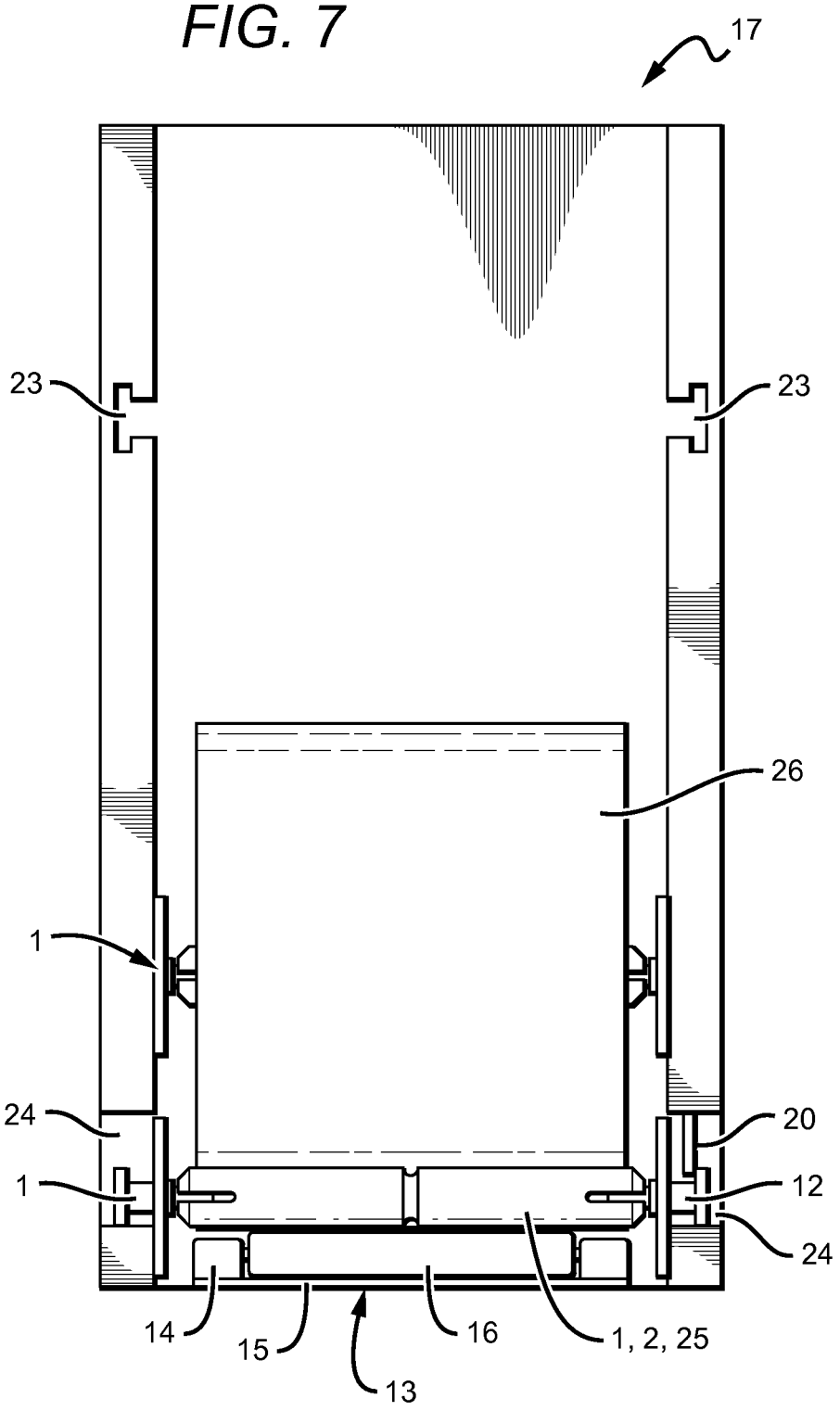
FIG. 7 is a front view of the dispenser of FIG. 5 with the primary roll of toilet paper depleted and the secondary roll of toilet paper in the lower dispensing position.

FIG. 7 shows a front view of dispenser 17, in which primary roll 25 has been depleted and secondary roll 26 has dropped into the lower dispensing position. With primary roll 25 depleted, elongated member 2 of spindle 1 is now resting on spindle 16. Section 12 of end member 7 has dropped below trigger end 20, causing hold end 19 to rotate backward, thus allowing secondary roll 26 to drop into the dispensing position.

Figure 8:
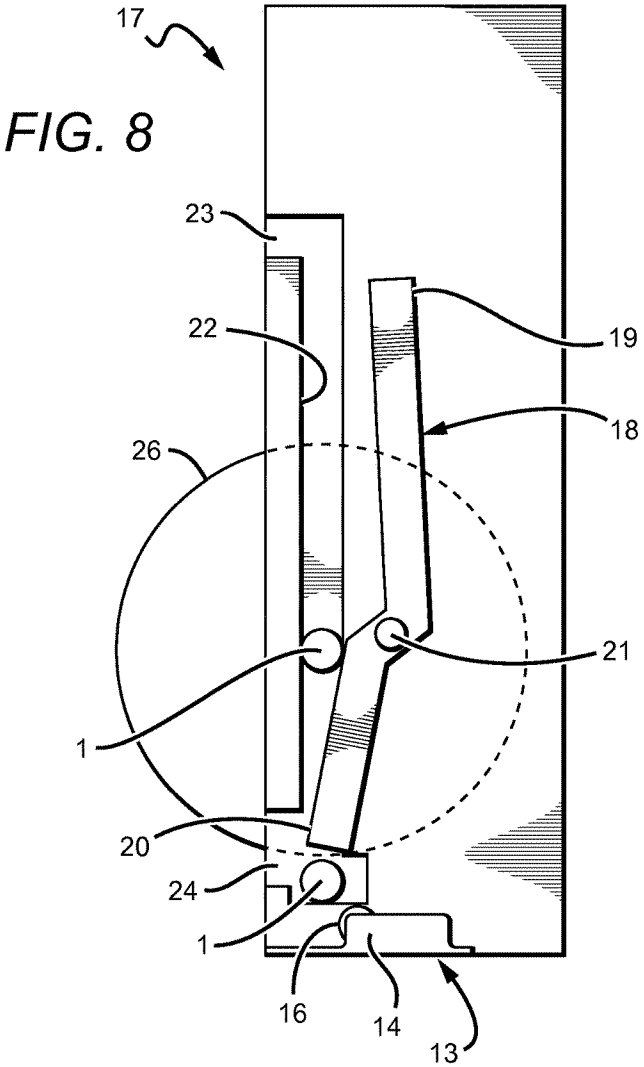
FIG. 8 is a side view of the dispenser of FIG. 5 with the primary roll of toilet paper depleted and the secondary roll of toilet paper in the lower dispensing position.

FIG. 8 shows a side view of dispenser 17, with primary roll 25 depleted and secondary roll 26 dropped into the lower dispensing position. As primary roll 25 was dispensed, the diameter of roll 25 was gradually reduced, causing section 12 of spindle 1 to move down track 22. When primary roll 25 was depleted, section 12 moved below trigger end 20. Gravity forced release mechanism 18 to rotate at pivot point 21, thus moving trigger end 20 forward and hold end 19 backward. When hold end 19 rotated backward primary roll 26 dropped from the upper reserve position into the lower dispensing position. Spindle 16 of roller assembly 13 prevented primary roll 25 from activating release mechanism 18 until primary roll 25 was completely depleted, thus minimizing paper product waste. While hold end 19 comprises a 90 degree angle with respect to mechanism 18, steeper angles are contemplated in order to increase the gravitational force of roll 26 against mechanism 18.

Those of skill in the art will appreciate that non-vertical dispensers could also be used consistently with the inventive subject matter disclosed herein. For example, a horizontal dispenser having a spring that advances the rolls of paper product along a horizontal track could be used with the spindle and roller assembly disclosed herein. However, eliminating an extra spring by using gravity advantageously simplifies dispenser components. Furthermore, those of skill in the art will appreciate that the inventive subject matter could be used for dispensers that store more than two rolls of paper product.

Unless the context dictates the contrary, all ranges set forth herein should be interpreted as being inclusive of their endpoints, and open-ended ranges should be interpreted to include commercially practical values. Similarly, all lists of values should be considered as inclusive of intermediate values unless the context indicates the contrary.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A spindle for dispensing a roll of paper product, comprising:

a first end member;

a second end member;

a monolithic elongated member having a hollow interior and a first side opening that provides access to the hollow interior;

wherein the first side opening has a diameter that is smaller than an inner diameter of the hollow interior;

wherein first and second end members rotatably couple with the elongated member such that the first and second end members can rotate with respect to the elongated member;

wherein the first end member has a reduced diameter section disposed between a first diameter section and second diameter section, the reduced diameter section having a smaller diameter than the first diameter section and the second diameter section;

wherein the first side opening can expand to removably receive the first diameter section of the first end member;

wherein the second diameter section comprises a flange that is sized and dimensioned to slideably engage a track of a dispenser; and wherein the reduced diameter section, first diameter section, and second diameter section are sized and dimensioned to limit translation of the first end member relative to the first side opening.

2. The spindle of claim 1, wherein the elongated member has:

a second side opening that provides access to the hollow interior; and wherein the first side opening and the second side opening of the elongated member, each have a diameter smaller than the inner diameter of the hollow interior.

3. The spindle of claim 2, wherein the first diameter section has a maximum diameter smaller than the inner diameter of the hollow interior and larger than the diameter of the first opening.

4. The spindle of claim 3, wherein the reduced diameter section has a maximum diameter that is smaller than the maximum diameter of the first and second side openings.

5. The spindle of claim 4, wherein the second diameter section has a maximum diameter that is greater than the inner diameter of the hollow interior.

6. The spindle of claim 5, wherein the first diameter section has a tapered profile.

7. The spindle of claim 6, wherein the elongated member comprises a material having an elasticity that allows the first diameter section of the first end member to be inserted into the first and second side openings of the elongated member without causing substantial permanent deformation of the elongated member.

8. The spindle of claim 1, wherein both first and second end members are configured to removeably couple with the elongated member.

9. The spindle of claim 1, wherein the elongated member has an outer diameter smaller than an inner diameter of a center aperture of the roll of paper product.

10. The spindle of claim 1, wherein the elongated member has an outer diameter substantially equal to an inner diameter of a center aperture of the roll of paper product.

11. A dispenser for dispensing a plurality of rolls of paper products, comprising:

a housing defining an interior space configured to store at least two rolls of paper products;

a first spindle comprising;

a first end member;

a second end member;

a monolithic elongated member having a hollow interior and a first side opening that provides access to the hollow interior;

wherein the first side opening has a diameter that is smaller than an inner diameter of the hollow interior;

wherein first and second end members rotatably couple with the elongated member such that the first and second end members can rotate with respect to the elongated member;

wherein the first end member has reduced diameter section disposed between a first diameter section and second diameter section, the reduced diameter section having a smaller diameter than the first diameter section and the second diameter section;

wherein the first side opening can expand to removably receive the first diameter section of the first end member; and wherein the reduced diameter section; first diameter section, and second diameter section are sized and dimensioned to limit translation of the first end member relative to the first side opening;

a second spindle comprising:

a first end member;

a second end member;

a monolithic elongated member having a hollow interior and a first side opening that provides access to the hollow interior;

wherein the first side opening has a diameter that is smaller than an inner diameter of the hollow interior;

wherein first and second end members rotatably couple with the elongated member such that the first and second end members can rotate with respect to the elongated member;

wherein the first end member has a reduced diameter section disposed between a first diameter section and second diameter section, the reduced diameter section having a smaller diameter than the first diameter section and the second diameter section;

wherein the first side opening can expand to removably receive the first diameter section of the first end member; and wherein the reduced diameter section, first diameter section, and second diameter section are sized and dimensioned to limit translation of the first end member relative to the first side opening;

first and second tracks disposed in the interior space of the housing, wherein first and second tracks are configured to receive at least a portion of first and second end members of the first and second spindles; and a roller disposed in the interior space of the housing and configured to (i) contact a roll of paper product during dispensing, and (ii) rotate with respect to the housing.

12. The dispenser of claim 11, wherein the interior space is configured to vertically store two rolls of paper product.

13. A spindle for dispensing a roll of paper product, comprising:

a first end member;

a second end member;

a monolithic elongated member having a hollow interior, and first and second side openings that provide access to the hollow interior;

wherein the first side opening has a diameter that is smaller than an inner diameter of the hollow interior;

wherein first and second end members rotatably couple with the elongated member such that the first and second end members can rotate with respect to the elongated member;

wherein the first end member has a reduced diameter section disposed between a first diameter section and second diameter section, the reduced diameter section having a smaller diameter than the first diameter section and the second diameter section;

wherein the first side opening can expand to removably receive the first diameter section of the first end member;

wherein the reduced diameter section, first diameter section, and second diameter section are sized and dimensioned to limit translation of the first end member relative to the first side opening; and wherein the elongated member comprises a material having an elasticity that allows the first diameter section of first end member to be inserted into the first and second side openings of the elongated member without causing substantial permanent deformation of the elongated member.

14. The spindle of claim 13, wherein the second diameter section comprises a flange that is sized and dimensioned to slideably engage a track of a dispenser.

15. The spindle of claim 13, wherein the elongated member comprises a second side opening that provides access to the hollow interior, and wherein the first side opening and the second side opening of the elongated member, each have a diameter smaller than the inner diameter of the hollow interior.

16. The spindle of claim 15, wherein the first diameter section has a maximum diameter smaller than the inner diameter of the hollow interior and larger than the diameter of the first opening.

17. The spindle of claim 16, wherein the reduced diameter section has a maximum diameter that is smaller than the maximum diameter of the first and second side openings.

18. The spindle of claim 17, wherein the second diameter section has a maximum diameter that is greater than the inner diameter of the hollow interior.

19. The spindle of claim 18, wherein the first diameter section has a tapered profile.

20. The spindle of claim 13, wherein the elongated member has an outer diameter smaller than an inner diameter of a center aperture of the roll of paper product.

* * * * *